US006095935A

United States Patent [19]

Gooselaw et al.

[11] Patent Number: 6,095,935

[45] Date of Patent: Aug. 1, 2000

[54] TURF REPAIR SYSTEM

[76] Inventors: Donald Gooselaw, 730 - 9th St. North, Fargo, N. Dak. 58102; Sharon Cannon, 1001 S. 10th St., Fargo, N. Dak. 58103

[21] Appl. No.: 09/209,584

[22] Filed: Dec. 11, 1998

[51] Int. Cl.[7] ..... A63B 57/00

[52] U.S. Cl. ..... 473/408; 294/19.1

[58] Field of Search ..... 473/286, 408; D21/793; 294/19.1, 19.2

[56] References Cited

U.S. PATENT DOCUMENTS

| | | | |
|---|---|---|---|
| D. 300,760 | 4/1989 | Krokus, Sr. | D21/793 |
| D. 383,516 | 9/1997 | Stevens | D21/793 |
| 3,771,794 | 11/1973 | Crockett | 473/286 |
| 3,854,727 | 12/1974 | Alexander | 473/286 |
| 4,925,190 | 5/1990 | Learned | 473/286 |
| 5,029,854 | 7/1991 | Laskowitz et al. | 473/408 |
| 5,277,425 | 1/1994 | Petriano, Sr. | 473/286 |
| 5,437,449 | 8/1995 | Zink | 473/286 |

*Primary Examiner*—Steven Wong
*Attorney, Agent, or Firm*—Michael S. Neustel

[57] ABSTRACT

A turf repair system for repairing a damaged turf surface without the user having to bend over. The inventive device includes a shaft, a handle attached an end of the shaft, a stopper member attached to the shaft opposite of the handle, and a pair of prongs immovably attached to the stopper member. The stopper member preferably has a semi-spherical shape with a swaged surface adjacent the pair of prongs. The handle has a putter head shape for use as a conventional putter if desired. A length of gripping is preferably positioned about the shaft adjacent the stopper member. During use, the user grasps the handle or shaft and positions the prongs adjacent to the damaged area. The user then forces the prongs into the turf until the stopper member engages the turf. The user then twists and lifts the ends of the prongs thereby repairing the damaged area. When finished, the user may insert the prongs directly into the turf surrounding the green where it is self-standing until the user is finished with the hole.

13 Claims, 4 Drawing Sheets

TURF REPAIR SYSTEM

BACKGROUND OF THE INVENTION

1. Field of the Invention

The present invention relates generally to turf repair tools and more specifically it relates to a turf repair system for repairing a damaged turf surface without the user having to bend over.

Golfers often damage specific locations upon a golf course during play such as divots upon a surface of a green. The golfer is supposed to "repair" the damaged green by "pulling up" the newly formed divot or depression. Conventional tools for repairing the green require the user to bend over or kneel down to repair the damage. This is extremely uncomfortable for some golfers, especially for the elderly or the physically challenged. Because it is physically difficult for some golfers to repair the green or turf, they will sometimes leave the green damaged without repair.

Over time, the greens and the turf become permanently damaged from this misuse. Repairing a severely damaged golf turf can be extremely expensive for a golf course. In addition, golf courses are forced to hire extra groundkeepers to repair the divots and depressions that certain golfers cause to the golf turf. Therefore, there is a need for a device that will allow golfers of all physical capabilities to repair the golf turf.

2. Description of the Prior Art

Turf repair tools have been in use for years. Typically, a turf repair tool is a hand held device that has two prongs extending out from it. The user grasps the relatively small tool with their bare hands and must bend over near the damaged area. The user then must simultaneously insert the conventional tool into the damaged area and twist it to repair the turf's surface.

This is a very undesirable method of repairing a golf turf for most golfers not only because they must physically bend over, but also because they run the risk of contaminating their pants while kneeling down. In addition, some golfers may physically be incapable of repairing their own divots or depressions so the damage goes needlessly unrepaired. Also, groundkeepers must repair these unrepaired divots and depressions following the golfers' game. The groundkeepers must bend over or kneel down numerous times which can be physically and mentally exhausting. It can also be an extremely time consuming job for a groundkeeper because they must constantly be bending over and standing up again in order to repair the golf turf.

Examples of turf repair devices include U.S. Pat. No. 4,862,970 to Hlavacek; U.S. Pat. No. 5,511,785 to Rusin, Jr.; U.S. Pat. No. 4,239,216 to Bauer; U.S. Pat. No. 3,185,483 to Klynman; U.S. Pat. No. 1,657,322 to Shinn; and U.S. Pat. No. 5,562,553 to Digerness et al are all illustrative of such prior art.

Hlavacek (U.S. Pat. No. 4,862,970) discloses a greens repair tool. Hlavacek teaches an elongated casing positioned within an end of a golf club defining a central chamber that slidably retains a fork. The fork is retained within the casing when not in use and may be pulled out a certain distance to use. Hlavacek requires the use of many moving components that are prone to breakage. In addition, the user is forced to grasp the dirt contaminated end of the fork during play thereby undesirably soiling their hands and clothing. Hlavacek is susceptible to accidentally releasing during use and going back into the casing because of the high longitudinal and twisting forces placed upon it. In addition, Hlavacek does not teach a means for retaining a vertical level of the turf during repair. Finally, Hlavecek does not teach a means for preventing the handle from becoming contaminated from the soil and other debris during repair.

Rusin, Jr. (U.S. Pat. No. 5,511,785) discloses a golf club with a shaft recessing divot tool. The divot tool is a cylindrical body having a pair of prongs extending therefrom with the main portion having a slot that engages a pin located in the hollow portion of the club shaft. The cylindrical body is movable from a first locked position wherein it is recessed to a second locked position wherein it is extended for use. Rusin, Jr. requires the use of a pin within the hollow shaft that is prone to breakage. Also, considering the relatively dirty environment the tool will be utilized in, the cylindrical body may become jammed within the hollow portion of the club shaft do to the build-up of debris. In addition, the user is forced to grasp the dirt contaminated end of the fork during play thereby undesirably soiling their hands and clothing. Rusin, Jr., as with Hlavacek, is susceptible to accidentally releasing during use and going back into the hollow portion of the club shaft because of the high longitudinal and twisting forces placed upon it.

Bauer (U.S. Pat. No. 4,239,216) discloses a golfer's greens keeping aid. Bauer teaches a casing having a lower portion engageable to a club shaft that contains a tool for repairing dents in the green.

Klynman (U.S. Pat. No. 3,185,483) discloses a golfer's turf-repairing implement and carrier therefor. Klynman teaches the use of a turf-repairing device that is adapted to be removably housed within a slot of the putter head.

While these devices may be suitable for the particular purpose to which they address, they are not as suitable for repairing a damaged turf surface without the user having to bend over. Conventional turf repair tools are difficult for the user to utilize because they require the user to kneel or bend down to repair the divot or depression. The prior art patents are too complex to be practical for use upon a golf course environment.

In these respects, the turf repair system according to the present invention substantially departs from the conventional concepts and designs of the prior art, and in so doing provides an apparatus primarily developed for the purpose of repairing a damaged turf surface without the user having to bend over.

SUMMARY OF THE INVENTION

In view of the foregoing disadvantages inherent in the known types of turf repair devices now present in the prior art, the present invention provides a new turf repair system construction wherein the same can be utilized for repairing a damaged turf surface without the user having to bend over.

The general purpose of the present invention, which will be described subsequently in greater detail, is to provide a new turf repair system that has many of the advantages of the turf repair devices mentioned heretofore and many novel features that result in a new turf repair system which is not anticipated, rendered obvious, suggested, or even implied by any of the prior art turf repair devices, either alone or in any combination thereof.

To attain this, the present invention generally comprises a shaft, a handle attached an end of the shaft, a stopper member attached to the shaft opposite of the handle, and a pair of prongs immovably attached to the stopper member. The stopper member preferably has a semi-spherical shape with a swaged surface adjacent the pair of prongs. The handle has a putter head shape for use as a conventional putter if desired. A length of gripping is preferably positioned about the shaft adjacent the stopper member. During use, the user grasps the handle or shaft and positions the prongs adjacent to the damaged area. The user then forces the prongs into the turf until the stopper member engages the turf. The user then twists and lifts the ends of the prongs thereby repairing the damaged area. When finished, the user may insert the prongs directly into the turf surrounding the green where it is self-standing until the user is finished with the hole.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a turf repair system that will overcome the shortcomings of the prior art devices.

Another object is to provide a turf repair system that can be utilized by golfers of all physical capabilities.

An additional object is to provide a turf repair system that does not require the golfer to kneel or bend over to repair a damaged turf surface.

A further object is to provide a turf repair system that does not have any moving components.

Another object is to provide a turf repair system that is self-standing during non-use thereby preventing the tool from becoming lost in a grassy area.

A further object is to provide a turf repair system that retains the vertical position of the turf during the repair action thereby preventing a humping effect upon the turf.

Another object is to provide a turf repair system that dramatically reduces the accumulation of debris upon the handle of the club handle.

Another object is to provide a turf repair system that does not damage surrounding golf clubs in a golf bag during insertion or removal.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
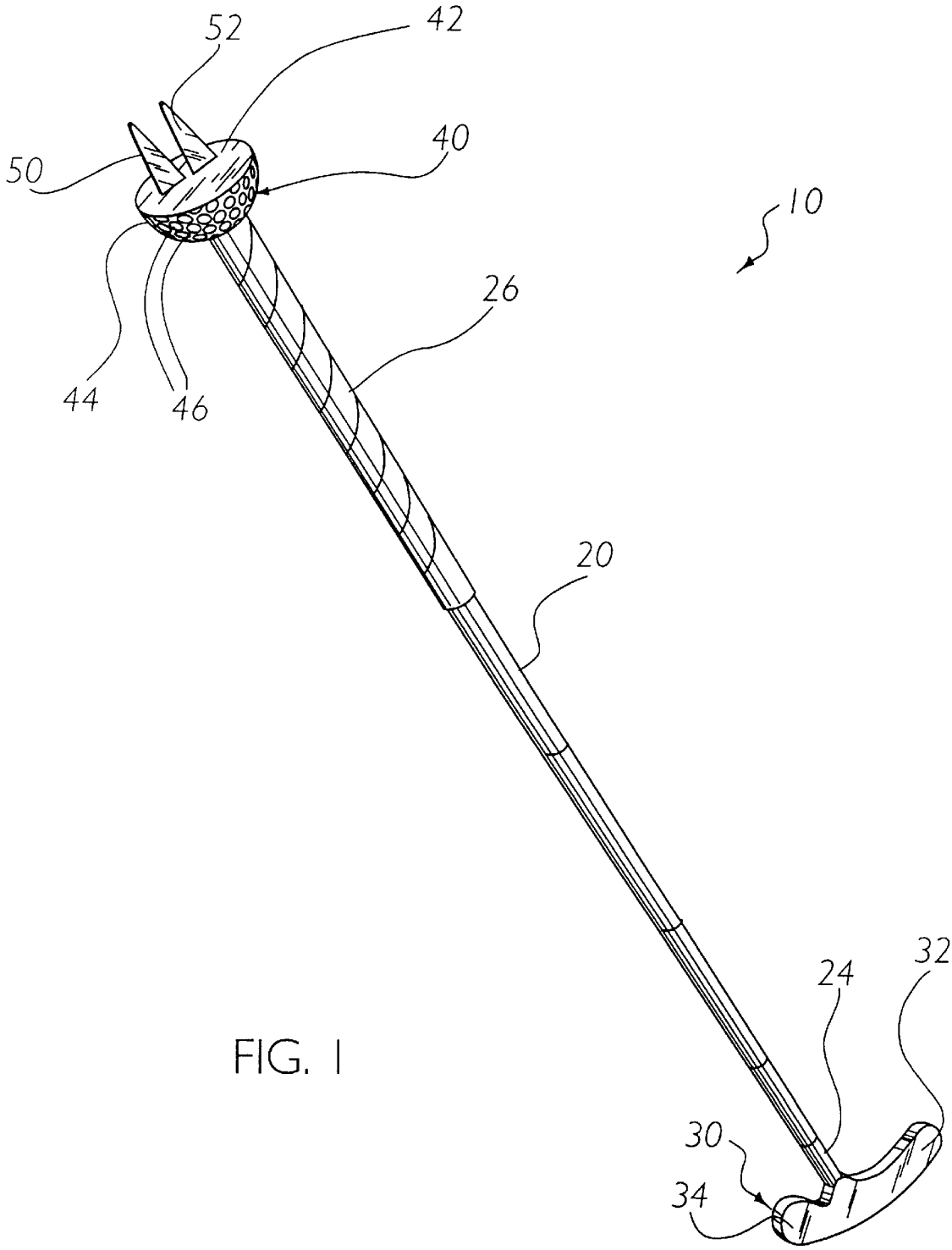
FIG. 1 is an upper perspective view of the present invention.

Turning now descriptively to the drawings, in which similar reference characters denote similar elements throughout the several view, FIGS. 1 through 4 illustrate a turf repair system 10, which comprises a shaft 20, a handle 30 attached an end of the shaft 20, a stopper member 40 attached to the shaft 20 opposite of the handle 30, and a pair of prongs 50, 52 immovably attached to the stopper member 40. The stopper member 40 preferably has a semi-spherical shape with a swaged surface adjacent the pair of prongs 50, 52. The handle 30 has a putter head shape for use as a conventional putter if desired. A length of gripping 26 is preferably positioned about the shaft 20 adjacent the stopper member 40. During use, the user grasps the handle 30 or shaft 20 and positions the prongs 50, 52 adjacent to the damaged area 14. The user then forces the prongs 50, 52 into the turf 12 until the stopper member 40 engages the turf 12. The user then twists and lifts the ends of the prongs 50, 52 thereby repairing the damaged area 14. When finished, the user may insert the prongs 50, 52 directly into the turf 12 surrounding the green where it is self-standing until the user is finished with the hole.

Figure 2:
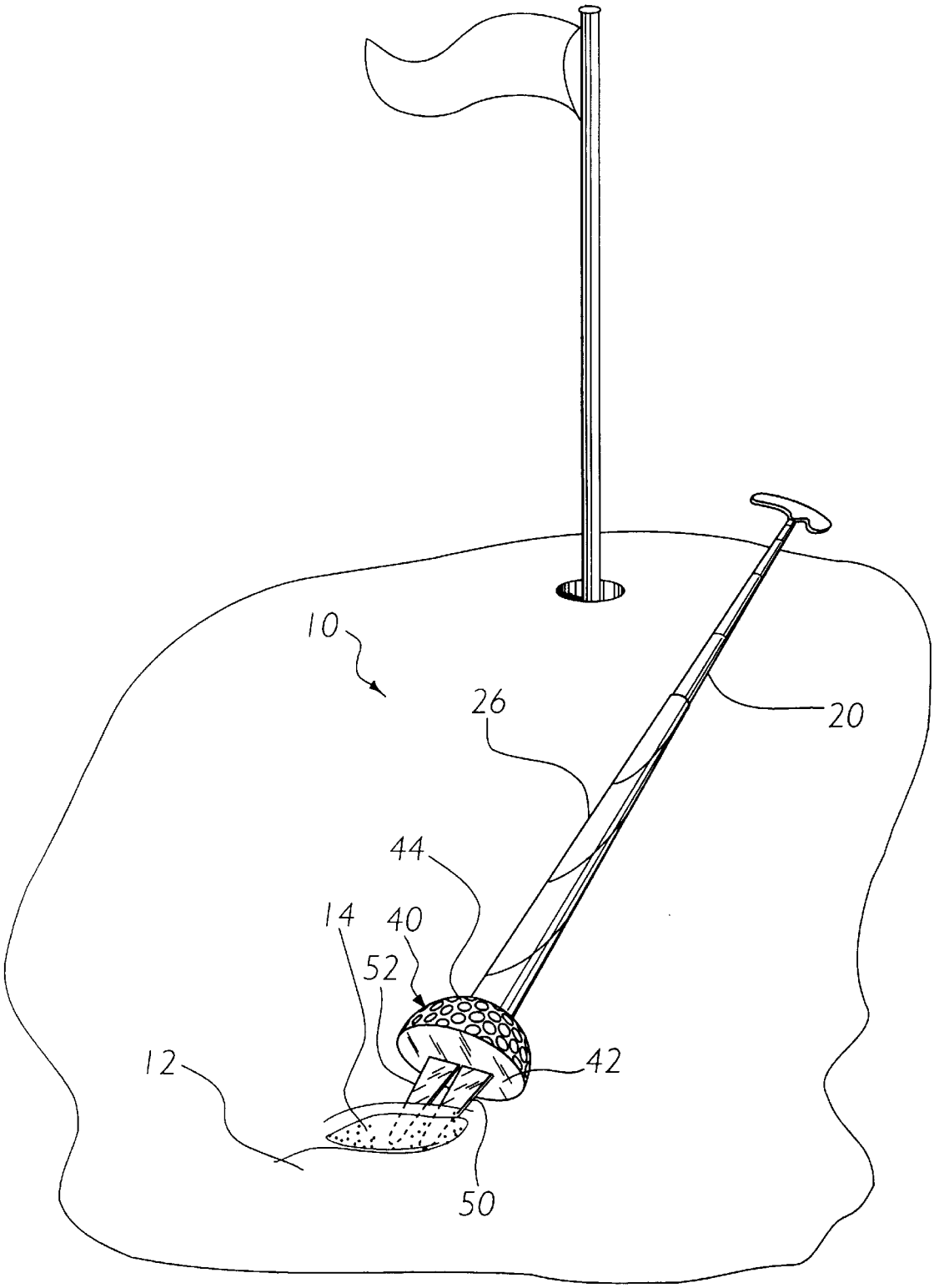
FIG. 2 is an upper perspective view of the present invention being utilized to repair a damaged area in the turf.
Figure 3:
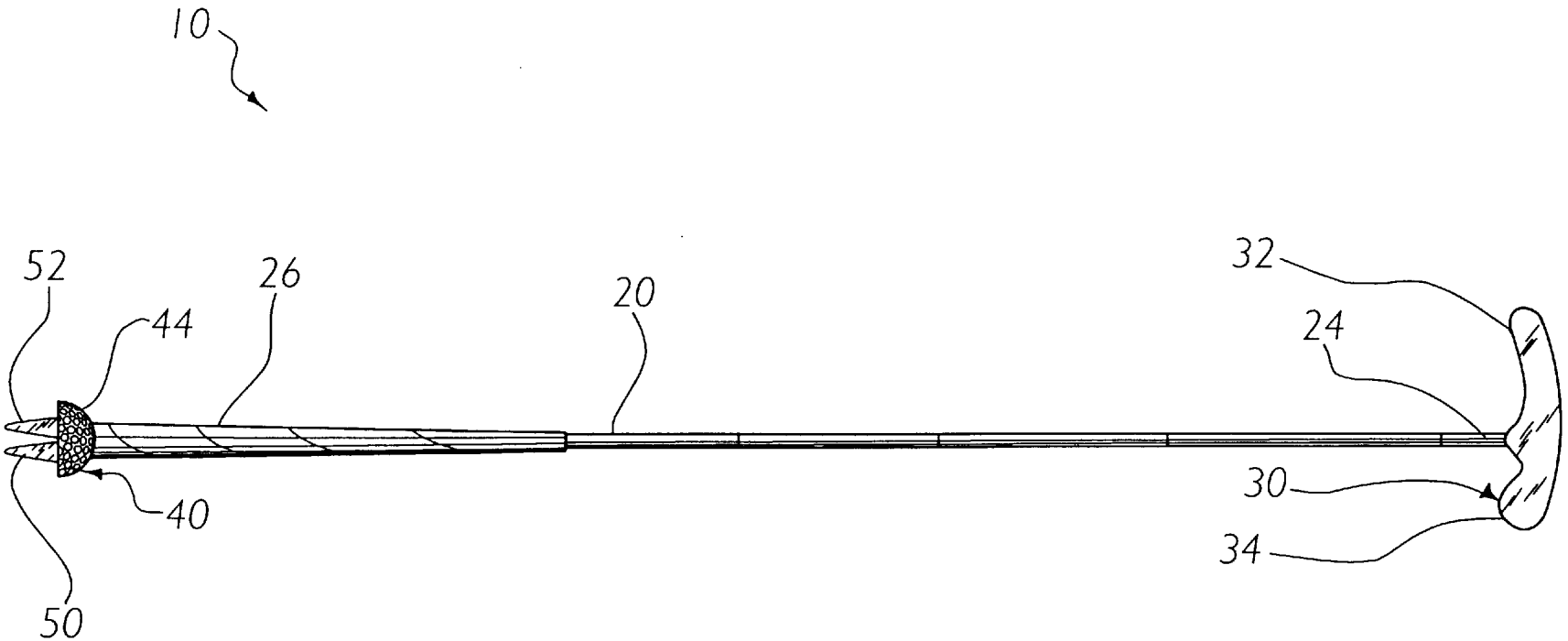
FIG. 3 is a side view of the present invention.

As shown in FIGS. 1 through 3 of the drawings, the shaft 20 is an elongated structure with a longitudinal axis. The shaft 20 may be constructed of any well-known material such as graphite or stainless steel. As best shown in FIG. 1, the shaft 20 has a first end and a second end 24. The shaft 20 may taper from the first end towards the second end 24 as shown in FIG. 1, or the diameter of the shaft 20 may be relatively consistent. A length of gripping 26 surrounds the first end as best shown in FIGS. 1 through 3.

A stopper member 40 is attached to the first end of the shaft 20 as shown in FIGS. 1 through 4. The stopper member 40 preferably has a semi-spherical member 44, however it can be appreciated that any well-known shape may be utilized. In addition, the semi-spherical member 44 preferably includes a plurality of dimples similar to that found upon a conventional golf ball. The semi-spherical member 44 may be comprised of any well-known material such as plastic.

A plate 42 is preferably attached to the semi-spherical member 44 opposite of the shaft 20 was shown in FIG. 2. The plate 42 is preferably comprised of a rigid material for engaging the ground surface without damage thereto. During use, the stopper member 40 engages the turf 12 for preventing excess penetration into the turf 12 and for preventing the turf 12 from building up into a ridge. The stopper member 40 also prevents the accumulation of debris upon the gripping 26 of the shaft 20. Also, the stopper member 40 provides support for the invention when the prongs 50, 52 are inserted into the turf 12 for temporary storage. It can be appreciated by one skilled in the art that the plate 42 can be attached to the shaft 20 without the semi-spherical member 44 attached thereto for support.

Figure 4:
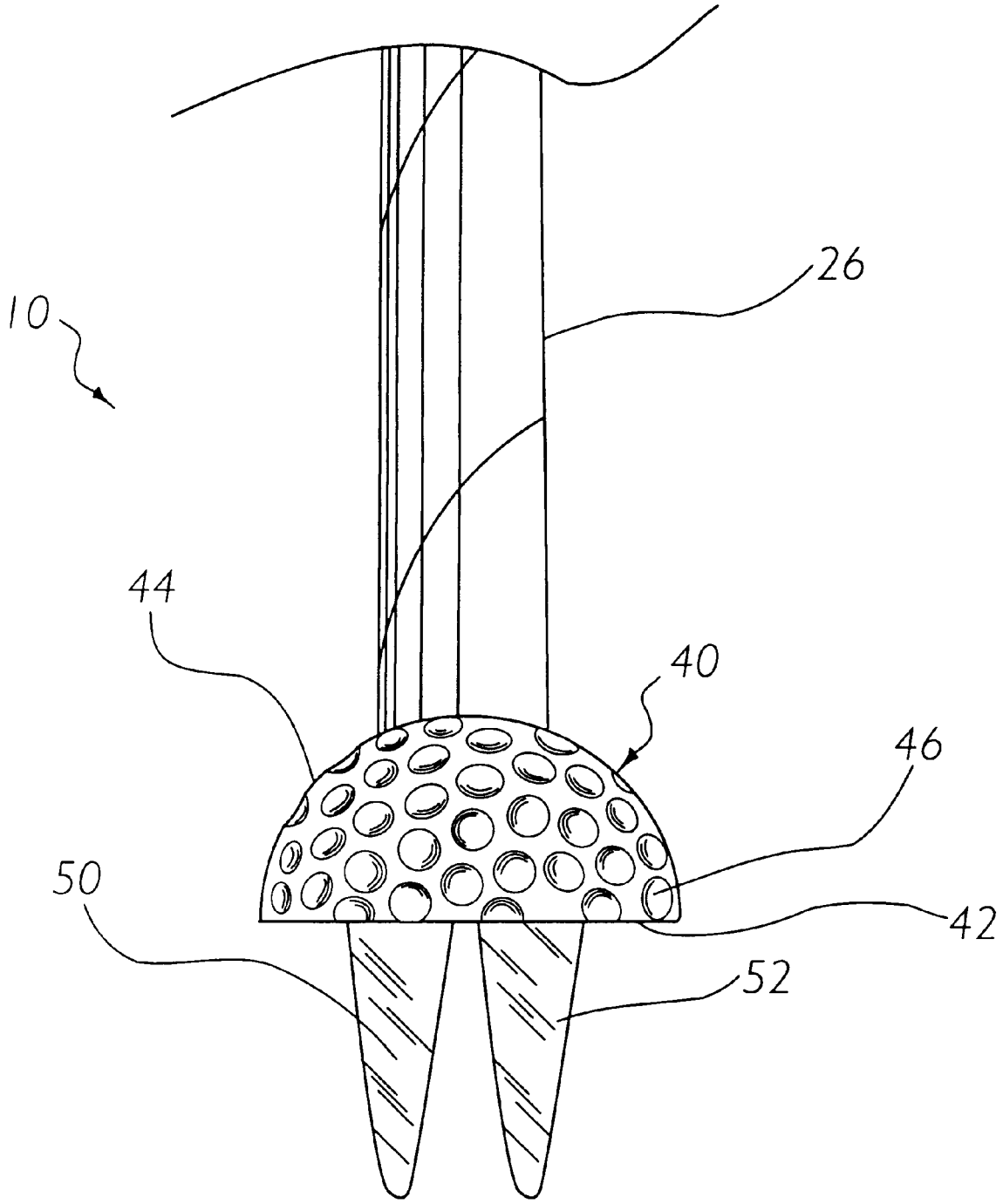
FIG. 4 is a magnified side view of the stopper member and the prongs attached to the handle.

As shown in FIG. 2, a pair of prongs 50, 52 are attached to the stopper member 40. The prongs 50, 52 may extend into the shaft 20 if desired for added support. The prongs 50, 52 preferably comprise a first prong 50 and a second prong 52 extending substantially orthogonally from the plate 42 of the stopper member 40. The prongs 50, 52 are preferably substantially parallel to one another as shown in FIG. 4. The prongs 50, 52 preferably taper toward the distal ends for allowing easy penetration into the turf 12 as is well-known in the art. The combined widths of the prongs is smaller than the diameter of the circular outer perimeters of the stopper member and the plate. The combined widths also being greater than the exterior diameter of the shaft. The distal ends of the prongs 50, 52 are preferably blunted for preventing damage to the turf 12 during use. It can also be appreciated that a single prong or multiple prongs 50, 52 may be attached to the stopper member 40 depending upon the conditions.

As shown in FIGS. 1 through 3, a handle 30 may be attached to the second end 24 of the shaft 20 for gripping 26 by the user with their hand. The handle 30 preferably is shaped similar to a putter head as best shown in FIG. 3, however various other shapes may be utilized. The handle 30 preferably has a first portion 32 and a second portion 34 on opposing sides of the shaft 20. The first portion 32 is preferably longer than the second portion 34, whereby the user mainly grasps the first portion 32 during use. The handle 30 may be constructed of any well-known material such as metal or plastic. It can be appreciated by one skilled in the art that the handle 30 is not required for utilizing the present invention since a user may grasp the first end of the shaft 20 opposite of the prongs 50, 52.

In use, the user locates a damaged area 14 within the turf 12. The user then grasps the handle 30 or the shaft 20 to manipulate the prongs 50, 52 near the damaged area 14. When the prongs 50, 52 are directly above or adjacent the damaged area 14, the user manipulates the invention so that the prongs 50, 52 penetrate into the turf 12 preferably at an acute angle. The edge portion of the plate 42 and the semi-spherical member 44 engage the upper surface of the turf 12 to limit the depth of penetration by the prongs 50, 52 as shown in FIG. 2 of the drawings. The user then utilizes the shaft 20 to leverage the prongs 50, 52 while simultaneously twisting the shaft 20 for repairing the damaged area 14. During this repair action, the plate 42 insures that the turf 12 is not raised above its previous level. The stopper member 40 also acts as a pivot point during pivoting of the shaft 20 and the prongs 50, 52. After the damaged area 14 is substantially repaired, the user removes the prongs 50, 52 from the turf 12 to view the repaired turf 12. If the repaired turf 12 has a raised portion, the user may insert the prongs 50, 52 into the area and force the plate 42 upon the raised portion thereby flattening the raised portion to a level of the surrounding turf 12. When finished, the user may insert the prongs 50, 52 into a surrounding turf 12 where the shaft 20 will be suspended substantially vertical in plain view of the user so as to not become lost while finishing the hole. If the user inserts the invention into a golf bag, the stopper member 40 prevents the prongs 50, 52 from engaging the surrounding clubs thereby reducing damage to the user's golf clubs.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

ENVIRONMENTAL ELEMENTS

10. Turf Repair System
11.
12. Turf
13.
14. Damaged Area
15.
16.
17.
18.
19.
20. Shaft
21.
22.
23.
24. Second End
25.
26. Gripping
27.
28.
29.
30. Handle
31.
32. First Portion
33.
34. Second Portion
35.
36.
37.
38.
39.
40. Stopper Member
41.
42. Plate
43.
44. Semi-Spherical Member
45.
46. Dimples
47.
48.
49.
50. First Prong
51.
52. Second Prong
53.
54.
55.
56.
57.
58.
59.
60.
61.
62.

63.
64.
65.
66.
67.
68.
69.
70.
71.
72.
73.
74.
75.
76.
77.
78.
79.

We claim:

1. A turf repair system comprising:

a shaft having a first end and a second end, wherein said shaft has a exterior diameter;

a rigid stopper member attached to said first end of said shaft, wherein said stopper member has a circular outer perimeter; and a pair of prongs permanently attached to said stopper member opposite of said shaft, wherein each of said pair of prongs are tapered, said prongs having a combined width smaller than a diameter of said circular outer perimeter for allowing said pair of prongs to be leveraged upon a ground surface and wherein said combined width of said pair of prongs is greater than said exterior diameter of said shaft.

2. The turf repair system of claim 1, including a handle attached to said second end of said shaft.

3. The turf repair system of claim 1, wherein said stopper member comprises:

a broad member surrounding said first end of said shaft; and a plate attached to said broad member adjacent said pair of prongs.

4. The turf repair system of claim 3, wherein said broad member has a semi-spherical shape.

5. The turf repair system of claim 1, including a length of gripping attached to said shaft adjacent said first end.

6. The turf repair system of claim 2, wherein said handle includes a first portion and a second portion on opposing sides of said shaft.

7. The turf repair system of claim 6, wherein said first portion is longer than said second portion.

8. The turf repair system of claim 7, wherein said handle has a putter head shape.

9. A turf repair system comprising:

a shaft having a first end and a second end, wherein said shaft has a exterior diameter;

a rigid plate attached to said first end, wherein said plate has a circular outer perimeter; and a pair of prongs permanently attached to said first end and said combined plate, wherein each of said pair of prongs are tapered, having a width smaller than a diameter of said circular outer perimeter for allowing said pair of prongs to be leveraged upon a ground surface and wherein said combined width of said pair of prongs is greater than said exterior diameter of said shaft.

10. The turf repair system of claim 9, including a handle attached to said second end of said shaft.

11. The turf repair system of claim 10, including a length of gripping attached to said shaft adjacent said first end.

12. The turf repair system of claim 11, wherein said handle includes a first portion and a second portion on opposing sides of said shaft, wherein said first portion is longer than said second portion.

13. The turf repair system of claim 12, wherein said handle has a putter head shape.

* * * * *